United States Patent [19]

Altman

[11] 4,147,040

[45] Apr. 3, 1979

[54] RADIATION COOLING DEVICES AND PROCESSES

[76] Inventor: Gerald Altman, 41 Westminster Rd., Newton, Mass. 02159

[21] Appl. No.: 679,858

[22] Filed: Apr. 23, 1976

Related U.S. Application Data

[60] Division of Ser. No. 445,052, Feb. 25, 1974, Pat. No. 3,861,384, and a continuation-in-part of Ser. No. 422,426, Dec. 6, 1973, abandoned.

[51] Int. Cl.[2] ..... F25B 21/02; G01J 1/04

[52] U.S. Cl. ..... 62/467 R; 62/DIG. 1; 250/504

[58] Field of Search ..... 62/DIG. 1, 467; 250/503, 504

[56] References Cited

U.S. PATENT DOCUMENTS

| | | | |
|---|---|---|---|
| 2,651,503 | 9/1953 | Mills | 62/DIG. 1 |
| 2,949,014 | 8/1960 | Belton, Jr. et al. | 62/DIG. 1 |
| 3,796,886 | 3/1974 | Freeman | 250/503 |
| 3,801,785 | 4/1974 | Barrett | 250/503 |
| 3,959,660 | 5/1976 | Tolliver | 250/504 |
| 4,030,316 | 6/1977 | Azonson | 62/467 |

*Primary Examiner*—Ronald H. Lazarus
*Assistant Examiner*—P. S. Lall
*Attorney, Agent, or Firm*—Morse, Altman, Oates & Bello

[57] ABSTRACT

Intensified infrared cooling of a restricted region is achieved by locating the region in the path defined by a geometric configuration, in which a small electrostatic infrared radiation sink and a large infrared radiation condenser are axially related.

12 Claims, 11 Drawing Figures

$$Q = A_1 F_1 \sigma (Th_1^4 - Tc_1^4)$$

RADIATION COOLING DEVICES AND PROCESSES

RELATED APPLICATION

This is a division of application Ser. No. 445,052, filed Feb. 25, 1974 U.S. Pat. No. 3,861,384 and continuation-in-part of application Ser. No. 422,426, filed Dec. 6, 1973 now abandoned.

BACKGROUND

1. Field of the Invention

The present invention relates to cooling devices and processes and, more particularly, to the cooling of restricted regions.

2. The Prior Art

Most conventional cooling techniques involve the indiscriminate cooling of relatively large environments even though local cooling of relatively small regions only may be desired. Heat transfer as is well known, involves the phenomena of conduction, convection and radiation. All of these phenomena operate in conventional cooling systems although conventional design often is based primarily on conduction and convection considerations.

SUMMARY OF THE INVENTION

The present invention is based on the discovery that intensified infrared cooling of a restricted subject region can be achieved by locating the subject region in the path defined by a geometric configuration, in which a small infrared radiation sink and a large infrared radiation condenser, e.g. a converging reflector, are axially related. Preferably the radiation sink is isolated from the atmosphere by an infrared transmitting envelope which precludes precipitation of moisture and which transmits infrared radiation directed from the subject region via the radiation condenser to the radiation sink. Preferably heat is removed from the radiation sink by a thermoelectric heat exchanger which is connected to the radiation sink by a heat conductor that includes an externally insulated pipe and internally convective fluid. The radiation sink, particularly the surface area communicating with the radiation condenser, is operationally electrostatic, i.e. is not a component of a closed electrical loop. In other words the heat sink is electromotively isolated so as to be free of power dissipation that is significant in relation to infrared radiation received from the subject. The cooling configuration of the present invention is the antithesis of irradiating configurations of the prior art in the sense that the present invention predeterminedly locates a "point" radiation sink in adjacence to the focal point of an optical condensing system whereas the prior art predeterminedly locates a "point" radiation source in adjacence to the focal point of an optical condensing system. The present invention is believed to take advantage of the scientific principle that the aperture of an optical system assumes the radiance of the object it is imaging when viewed from the image point. The present invention effectively reduces mechanical problems previously inherent in radiation cooling devices. These devices are particularly useful in the maintainance of controlled temperatures for individualized cooling or medical therapy or for scientific or industrial procedures in which convenient mechanical access is precluded, for example, with respect to subject surfaces of irregular shape or minute size.

Other objects of the present invention will in part be obvious and will in part appear hereinafter.

The present invention thus comprises the devices and processes, together with their components, steps and interrelationships, which are exemplified in the present disclosure, the scope of which will be indicated in the appended claims.

BRIEF DESCRIPTION OF THE DRAWINGS

For a fuller understanding of the nature and objects of the present invention, reference is made to the following detailed description, taken in connection with the accompanying drawings, wherein.

DETAILED DESCRIPTION OF THE PREFERRED EMBODIMENT

Figure 1:
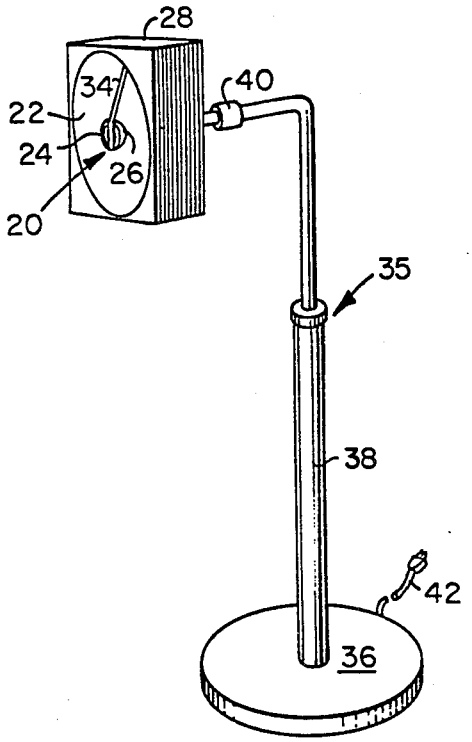
FIG. 1 is a perspective view of a radiation cooling device embodying the present invention.
Figure 2:
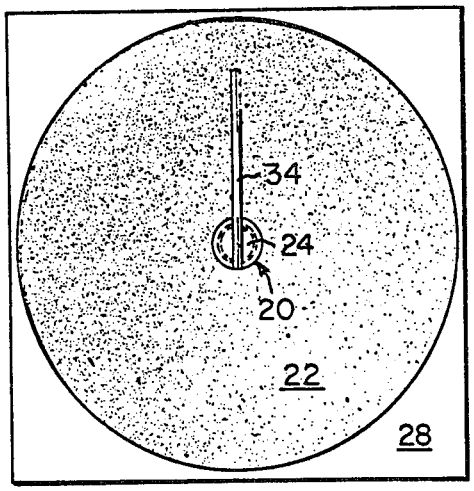
FIG. 2 is a front plan view of a component of the device of FIG. 1.
Figure 3:
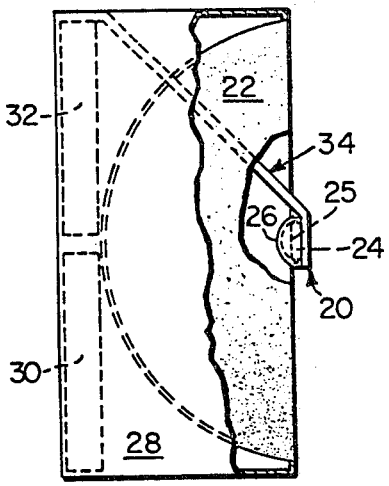
FIG. 3 is a side elevation of the component of FIG. 2.

The radiation cooler of FIGS. 1, 2 and 3 comprises a heat sink 20 and a converging reflector 22. Heat sink 20 includes a forward heat conducting base 24 having a rearward black body coat 25, and a rearwardly facing infrared radiation transmitting envelope 26, the interior of which is evacuated. Converging reflector 22 is mounted in a housing 28 within which are an AC to DC transformer 30 and a thermoelectric heat exchanger 32. Heat sink 20 is connected to thermoelectric head exchanger 32 and positioned with respect to reflector 22 by a rigid heat conduit 34. As shown in FIG. 1, housing 28 is mounted universally on a stand 35 having a stable base 36, a vertically extensible section 38 and a universally pivoted section 40. An extension cord 42 powers transformer 30, which in turn powers heat exchanger 32. The theoretical basis of the present invention is not understood with certainty. However, the operation of the radiation cooler of the present invention is believed to depend upon the following theoretical considerations. Generally heat transfer by infrared radiation occurs between a relatively hot surface and a relatively cold surface in accordance with the following formula $$Q = A\,F\,\sigma(T_n^4 - T_c^4)$$

where

Q = heat transferred per unit time (Btu/hr)

A = area of one of the surfaces ($ft^2$)

F = a dimensionless configuration factor that is a direct function of the magnitudes of the areas of both surfaces, the degree of parallelism of the surfaces, the closeness of the spacing of the surfaces, the closeness of the approximation to black body emissivity of the surfaces, and ambient conditions;

$\sigma$ = the Stefan-Boltzman constant ($0.171\times10^{-8}$ Btu/ft$^2$ h [deg R]$^4$)

$T_n$ = the absolute temperature of the hot surface (degree R) and $T_c$ = the absolute temperature of the cold surface (degree R)

(R stands for Rankin = degrees F + 460)

The foregoing indicates that cooling by infrared radiation is a direct function of surface area. Difficulties are encountered in attempting to utilize a large open cooling surface for radiation transfer when temperature is below freezing because of mechanical problems, particularly difficulties associated with frost prevention. In accordance with the present invention, a geometrically small heat sink, in which frost and other mechanical problems can be easily controlled, is converted effectively into a geometrically large heat sink by disposing it on the axis of an infrared optical condenser of relatively large diameter.

Figure 4:
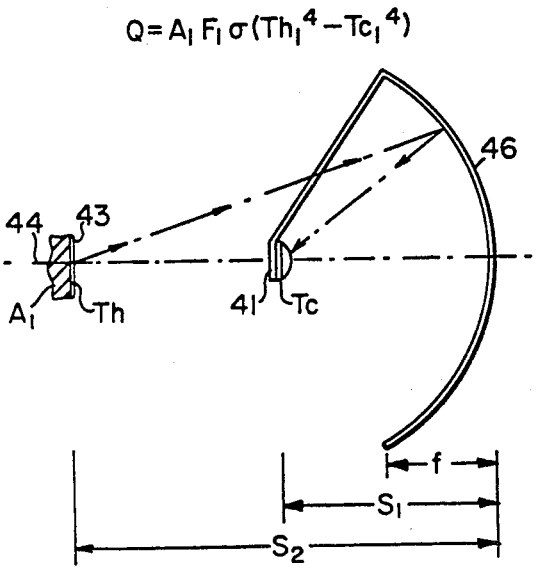
FIG. 4 is a schematic diagram illustrating a first system of the present invention.
Figure 5:
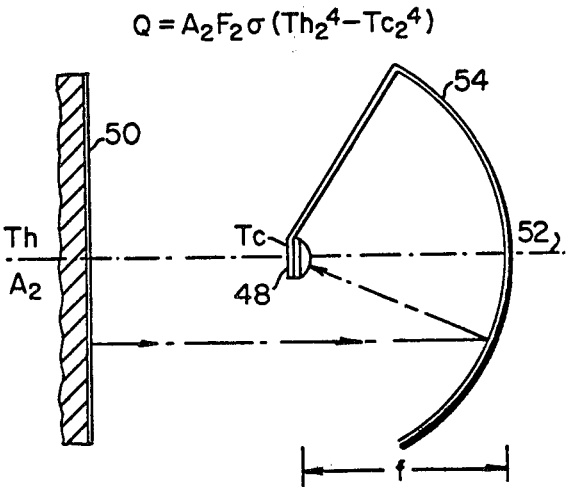
FIG. 5 is a schematic diagram illustrating a second system of the present invention.

The configuration of the reflector, in various modifications is spherical, parabolic, elliptical or aspheric. In FIG. 4, for example, a heat sink 41 and a subject region 43 of restricted area $A_1$, to be cooled, are positioned at conjugate points along the axis 44 of reflector 46. The configuration factor $F_1$, is such that a significant proportion of divergent radiation from subject region 43 is converged by reflector 46 toward heat sink 41. In FIG. 5, for example, the heat sink 48 and a subject region 50 of extended area $A_2$, to be cooled, are positioned respectively at the focal point and at infinity along the axis 52 of reflector 54. The configuration factor $F_2$ is such that a significant proportion of parallel radiation from subject region 50 is converged by reflector 54 toward heat sink 48.

From an optical standpoint, optimum positioning of the subject to be cooled may be determined approximately by calculating conjugate distances and magnifications of the heat sink and the subject surface in terms of what may be thought of as negative infrared or cooling rays emitted from the heat sink. More specifically, in FIG. 4, in the case where mirror 46 is spherical, the positions of sink 41 and subject 43 are related by the formulae:

$$(1/s_1)+(1/s_2)=(1/f) \text{ and } (A_1/A_2) = m$$

where:

f = focal distance of mirror 46

$s_1$ = distance of sink 40 from mirror 46

$s_2$ = distance of subject 42 from mirror 46

$A_1$ = area of sink 40

$A_2$ = area of subject 42 and m = magnification of the system.

In FIG. 4, in the case where mirror 46 is elliptical, sink 41 is positioned at the first focal point and subject 43 is positioned at the second focal point of the mirror. In FIG. 5, in the case where mirror 54 is parabolic, sink 48 is positioned at the focal point of mirror 54. In accordance with the present invention, it is preferred that, in terms of cross-sectional areas in planes that are normal to the optical axis, the area of the infrared radiation condenser is at least 5 times the area of the heat sink and that most of the exposed surface of the heat sink, say at least 80%, communicates optically with the infrared radiation condenser. In practice, the ratio of focal length to diameter of the infrared radiation condenser; i.e. the optical F/number, should not exceed 2.0.

Figure 6:
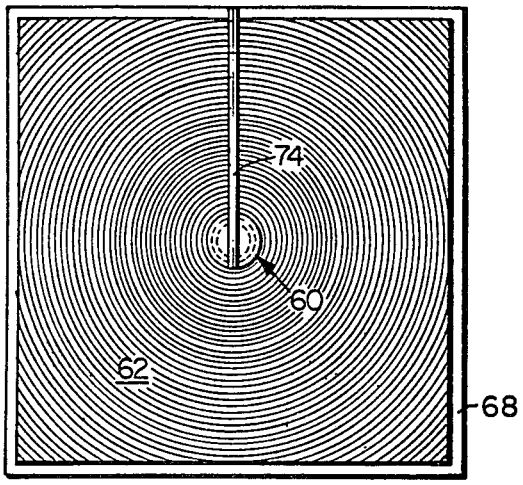
FIG. 6 is a front plan view of an alternative radiation cooling device embodying the present invention.
Figure 7:
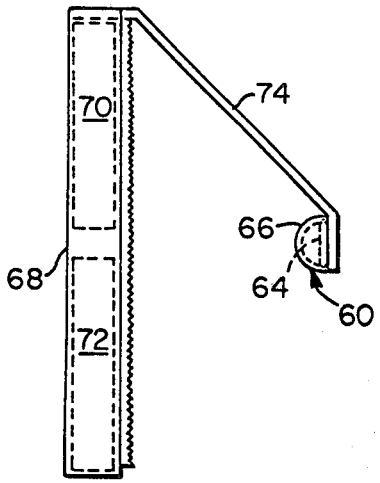
FIG. 7 is a side elevation of the device of FIG. 6.

In the modification of FIGS. 6 and 7, the radiation cooler comprises a heat sink 60 and a converging reflector 62. Heat sink 60 includes a rearwardly facing black body surface 64 and a rearwardly facing infrared radiation transmitting envelope 66, the interior of which is evacuated. Converging reflector is a Fresnel reflector that is mounted on a housing 68, in which are an AC to DC transformer 70 and a thermoelectric heat exchanger 72. Heat sink 60 is connected to heat exchanger 72 and positioned with respect to reflector 62 by a rigid heat conduit 74. Fresnel reflector 62, which is disposed in generally a flat plane, is characterized by concentric conoidal facets that correspond to any of the spherical, parabolic, elliptical or aspheric configurations of the reflector of FIG. 1.

Figure 8:
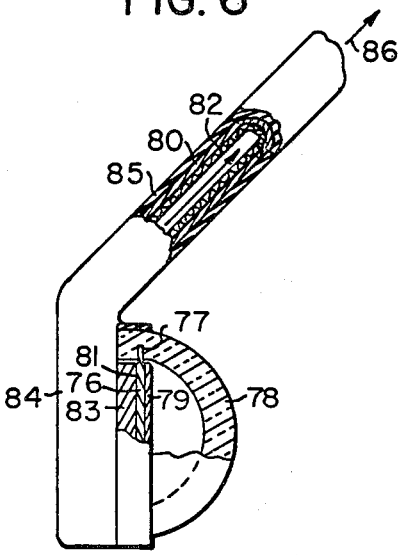
FIG. 8 is a fragmentary, broken-away view of certain components of the device of FIG. 1.

In one form Fresnel reflector 62 is composed of a thin metal, for example aluminum or magnesium. In another form, it is composed of a plastic, for example, methyl methacrylate or polycarbonate, which has been coated on its ridged, forward face with a vacuum deposited layer of aluminum or silver, ranging from 800 to 1500 angstrom units in thickness. As shown in FIG. 8, the heat sink comprises a substrate 76 composed preferably of a metal, particularly of a nickel-iron metal alloy such as kovar, invar or platenite which has the same thermal coefficient of expansion as envelope 78. This substrate has a flanged rim 77 for hermetic junction with the envelope, shown at 78. The face of sink 76 within the envelope is either anodized or coated with a carbon pigment or lacquer 79 to provide a black face having a uniform absorbitivity throughout its area that approaches black body absorbitivity, preferably an absorbitivity of at least 0.75. Substrate 76 is in thermally conductive contact, by means of an interposed thermally conductive hydrocarbon grease 81, with a support wafer 83 is welded to the heat pipe. Substrate 76 is secured to support wafer 83 by a central screw (not shown) which extends integrally from substrate 76 and is turned into a threaded bore (not shown) in support wafer 83. Preferably, envelope 78 is composed of an infrared transmitting material such as fused quartz, saphire, magnesium fluoride, magnesium oxide, calcium fluoride, arsenic trisulfide, zinc sulfide, silicon, zinc selenide, germanium, sodium fluoride, cadmium telluride or thallium bromide-iodide. The arrangement is such that an uninterrupted thermally conductive path, i.e. all increments being characterized by a heat conductivity of at least 5 Btu/hr(ft$^2$) (° F.), extends between the substrate 76 underlying face 79 and heat conduit 84. As shown in FIGS. 4 and 5, it is essential that subject surface 43 or 50 be the only energy source communicating with heat sink surface 79 and heat sink substrate 76. In other words, the uninterrupted thermally conductive path established by heat sink surface 79, heat sink substrate 76 and heat conduit 84 is electromotively isolated, i.e. it avoids electromotive forces that would tend to generate heat by electrical flow in a circuit.

As shown in FIG. 8, typically each of heat pipes 34 and 74 includes an outer tube 80, an inner tube 82 and an interior cavity. Outer tube 80 is composed of copper or stainless steel. Inner tube 82 is composed of an open celled, porous network or wick composed of the same metal as the outer tube. The interior of the heat pipe is hermetically sealed by closed ends 84, 86. Within the heat pipe is a fluid, for example methanol or ammonia, which when vaporized at heated extermity 84 flows through the tube toward cooled extremity 86. At cooling extremity 86, the fluid condenses and is drawn by capilary action through wick 82 back toward heated extremity 84. The arrangement is such that rapid transport of heat from the heated extremity to the cooled extremity occurs with little temperature gradient. Heat pipes 34 and 74 and portions of heat sinks 20 and 60 are coated with insulation 85, which is composed for example of a natural or synthetic rubber.

Figure 9:
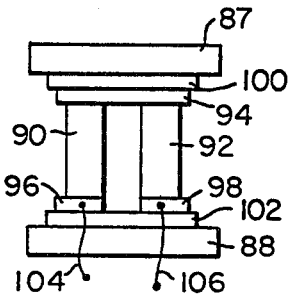
FIG. 9 is a schematic view of another component of the device of FIG. 1.

Preferably thermoelectric heat exchangers 32 and 72 are of the Peltier type, as shown in FIG. 9, in which a load 87 to be cooled and a heat sink 88 are separated by a pair of N and P semiconductors 90, 92. One end of each semiconductor 90, 92 is bonded to a common electrical conductor 94. The opposite extremities of semiconductors 90, 82 are bonded to isolated electrical conductors 96, 98. Electrical conductor 94 is attached to load 87 by a thermally conducting, electrically insulating spacer 100. Likewise, electrical conductors 96, 98 are attached to heat sink 88 by a thermally conducting, electrically insulating spacer 102. When direct current is transmitted via leads 104, 106 through electrical conductor 96, N semiconductor 90, electrical conductor 94, P semiconductor 92 and electrical conductor 98, cooling of load 87 occurs. In accordance with the present invention, a plurality of units of the type shown in FIG. 9 are disposed between load 87 and heat sink 88 to provide a heat exchanger that is matched with the thermal path extending from the heat sink to establish a heat flow of at least 10 Btu/hr(ft$^2$) (° F.) and, preferably, at least 50 Btu/hr(ft$^2$) (° F.) when associated with an infrared radiation condenser of one square foot area for medical applications.

Figure 10:
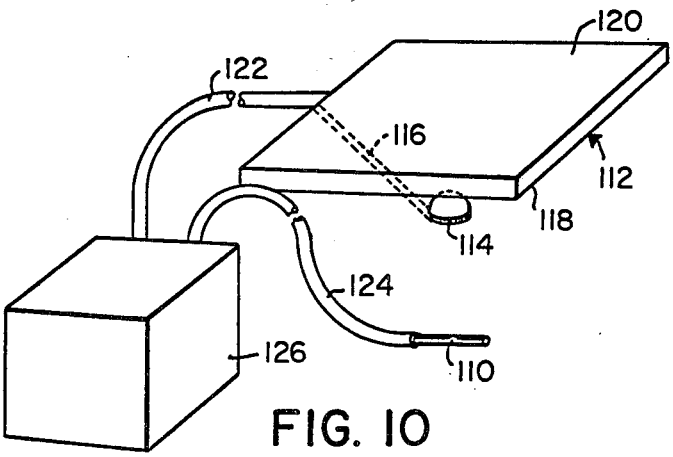
FIG. 10 is a perspective view of a system embodying the present invention.

The system of FIG. 10 comprises a temperature sensor 110 and a radiation cooler 112. Temperature sensor 110 is in the form of a thermocouple that can be taped to a portion to the body of the patient in order to monitor his body temperature. Radiation cooler 112, which is of the type shown in either FIGS. 2 and 3 or FIGS. 6 and 7, is positioned at a predetermined distance from the patient in order to increase infrared radiation from his body. In another form, heat sensor 110 is a pyrometer that is spaced from the patient's body. As shown, space cooler 112 comprises a heat sink 114, a heat pipe 116, a Fresnel reflector 118, and a Peltier effect thermoelectric heat exchanger 120, all of the types described up above. Heat exchanger 120 and temperature sensor 110 are connected by suitable leads 122, 124 to a controller 126, which includes a power supply for heat exchanger 120 and heat sensor 110, as well as an adjustable control circuit by which the patient's temperature can be monitored and controlled.

Figure 11:
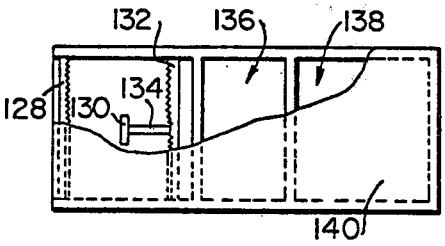
FIG. 11 is a cross-sectional view of an alternative device embodying the present invention.

The foregoing specific examples of the present invention have been based upon reflection of infrared radiation by infrared condensers of the reflection type. It is to be understood however that the term infrared condenser includes refractors, i.e. infrared lenses, composed, for example, of any of the infrared transmitting inorganic materials specified above or any of such plastic materials as polymethyl methacrylate, polystyrene, styrene acrylonitrite, polycarbonate, polymethyl pentane and polyphenylene oxide. One example of a refracting system embodying the present invention is shown in FIG. 11 as comprising an infrared Fresnel lens 128, a heat sink 130, an infrared Fresnel reflector 132, a heat pipe 134, a Peltier effect heat exchanger 136 and an AC to DC power supply 138, all enclosed within a housing 140.

In operation, each of the devices of FIGS. 1, 2 and 3, FIGS. 5 and 6, and FIG. 11 ordinarily is positioned with respect to a subject surface to be cooled in such a way that its heat sink is no farther away from the subject surface than a distance equal to twice the diameter of the reflector and such that the optical path from the infrared radiation emitting subject surface via the infrared radiation condenser to the infrared radiation absorbing heat sink is uninterrupted and unobscured so that heat flow from a subject surface to the heat sink and through the heat conduit is continuous. In other words, the device is positioned quite closely to the subject surface in order to achieve the desired heat flow. In accordance with the present invention, the infrared radiation of primary interest is in the range of from 0.8 to 50 microns, particularly in the range of from 4 to 40 microns, i.e. the range associated with the temperature of the human body. Preferably, envelopes 26, 66 are composed of a material that is substantially transparent in a major portion of the range of from 4 to 40 microns.

Since certain changes may be made in the present disclosure without departing from the present invention, it is intended that all matter contained in the foregoing description or shown in the accompanying drawings be interpreted in an illustrative and not in a limiting sense.

What is claimed is:

1. A process for cooling a subject thermal load that emits infrared radiation, said process comprising the steps of:

(a) locating a reflecting optical condenser means and a thermal radiation sink in proximity to said subject thermal load;

(b) focusing a portion of said infrared radiation via said optical condenser means onto the optical face of said thermal radiation sink;

(c) said optical face substantially constituting an optical point with respect to said optical condenser means;

(d) said optical face substantially constituting a black body with respect to said portion of infrared radiation;

(e) conducting a flow of heat from said optical face via an active heat exchanger;

(f) said flow of heat representing a substantial proportion of said portion of said infrared radiation.

2. The process of claim 1 wherein said proportion of said infrared radiation falls primarily in the range from 4 to 40 microns.

3. The process of claim 1 wherein said heat flow is at least 10 Btu/hr(ft$^2$) (° F.).

4. A process for cooling a subject thermal load emits infrared radiation substantially in the range of 4 to 40 microns, said process comprising the steps of:

(a) establishing a pair of proximate conjugate geometrical regions in relation to reflecting optical condenser means;

(b) locating said subject thermal load at one of said pair of proximate conjugate geometrical regions;

(c) locating the optical face of a thermal sink at the other of said pair of proximate conjugate geometrical regions, said optical face being electromotively isolated;

(d) said optical face substantially constituting an optical point with respect to said condenser means;

(e) said optical face substantially constituting a black body with respect to said infrared radiation;

(f) conducting a flow of heat from said optical face via an active heat exchanger;

(g) said flow of heat representing a substantial proportion of said infrared radiation; and (h) preventing frost accumulation on said optical face by shielding said optical face from the atmosphere with a window that is transparent to said infrared radiation.

5. The method of claim 4 wherein said optical condenser is spherical and said subject thermal load is no farther away from said optical face than a distance equal to twice the diameter of said condenser means.

6. The method of claim 4 wherein said optical condenser is aspheric and said subject thermal load is no farther away from said optical face than a distance equal to twice the diameter of said condenser means.

7. The method of claim 4 wherein said optical condenser is parabolic and said subject thermal load is no farther away from said optical face than a distance equal to twice the diameter of said condenser means.

8. The method of claim 4 wherein said optical condenser is ellipsoidal and said subject thermal load is no farther away from said optical face than a distance equal to twice the diameter of said condenser means.

9. The method of claim 4 wherein said heat flow is at least 10 Btu/hr(ft$^2$) (° F.).

10. A process for cooling at least a portion of the human body by infrared radiation emitted therefrom, said process comprising the steps of:

(a) locating a reflecting optical condenser means and a thermal radiation sink in proximity to said portion of said human body;

(b) focusing a portion of said infrared radiation via said optical condenser means onto the optical face of said thermal radiation sink;

(c) said optical face substantially constituting an optical point with respect to said optical condenser means;

(d) said optical face substantially constituting a black body with respect to said portion of said infrared radiation;

(e) conducting a flow of heat from said optical face via an electrically energized heat exchanger; and (f) said flow of heat representing a substantial proportion of said portion of said infrared radiation.

11. The process of claim 10 wherein said proportion of said infrared radiation falls primarily in the range of from 4 to 40 microns and said subject thermal load is no farther away from said optical face than a distance equal to twice the diameter of said condenser means.

12. The process of claim 10 wherein said subject thermal load is no farther away from said optical face than a distance equal to twice the diameter of said condenser means and said heat flow is at least 10 Btu/hr(ft$^2$) (° F.).

* * * * *